US012342882B2

(12) United States Patent
Horner et al.

(10) Patent No.: US 12,342,882 B2
(45) **Date of Patent: *Jul. 1, 2025**

(54) LAYERED THUMBHOLE STRUCTURE

(71) Applicant: NIKE, Inc., Beaverton, OR (US)

(72) Inventors: Stewart D. Horner, Portland, OR (US); Iustinia Koshkaroff, Portland, OR (US); Matthew D. Nordstrom, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/520,120

(22) Filed: Nov. 27, 2023

(65) Prior Publication Data

US 2024/0090601 A1 Mar. 21, 2024

Related U.S. Application Data

(60) Continuation of application No. 17/704,965, filed on Mar. 25, 2022, now Pat. No. 11,839,248, which is a (Continued)

(51) Int. Cl.
*A41D 27/10* (2006.01)
*A41B 1/08* (2006.01)

(Continued)

(52) U.S. Cl.
CPC ..... *A41D 27/10* (2013.01); *A41B 1/08* (2013.01); *A41B 7/00* (2013.01); *A41B 7/02* (2013.01);

(Continued)

(58) Field of Classification Search
CPC .. A41D 27/10; A41B 1/08; A41B 7/00; A41B 7/02; A41B 7/08
See application file for complete search history.

(56) References Cited

U.S. PATENT DOCUMENTS 415,676 A 11/1889 Magee
948,142 A 2/1910 Karp (Continued)

FOREIGN PATENT DOCUMENTS

KR 10-2004-0093414 A 11/2004
WO 2005/112677 A2 12/2005

(Continued)

OTHER PUBLICATIONS

International Search Report and Written Opinion dated May 19, 2016 for PCT Application No. PCT/US2016/018730, 11 pages.

(Continued)

*Primary Examiner* — Jameson D Collier
(74) *Attorney, Agent, or Firm* — Shook, Hardy & Bacon L.L.P.

(57) ABSTRACT

A sleeve cuff is provided for a sleeve including an anterior patch affixed to the sleeve and covering at least a portion of a cutout in the sleeve, a distal strap affixed to the sleeve and spanning over at least a portion of a cutout in the sleeve, and the distal strap overlapping at least a portion of the anterior patch to form an aperture for receiving a thumb therethrough. The sleeve cuff has a plurality of configurations, including at least a closed configuration where the aperture is closed and minimizes the wearer's exposure to wind and air elements therethrough, and an opened configuration where the aperture is opened and minimizes the air penetration around the received thumb.

20 Claims, 8 Drawing Sheets

Related U.S. Application Data division of application No. 16/512,058, filed on Jul. 15, 2019, now Pat. No. 11,317,664, which is a continuation of application No. 15/493,468, filed on Apr. 21, 2017, now Pat. No. 10,383,382, which is a continuation of application No. 15/045,465, filed on Feb. 17, 2016, now Pat. No. 9,681,689.

(60) Provisional application No. 62/242,760, filed on Oct. 16, 2015, provisional application No. 62/118,288, filed on Feb. 19, 2015.

(51) Int. Cl.

| | |
|---|---|
| ***A41B 7/00*** | (2006.01) |
| ***A41B 7/02*** | (2006.01) |
| ***A41D 3/08*** | (2006.01) |
| ***A41D 13/08*** | (2006.01) |
| ***A41D 27/24*** | (2006.01) |

(52) U.S. Cl.

CPC ..... *A41D 3/08* (2013.01); *A41D 13/08* (2013.01); *A41D 27/24* (2013.01)

(56) References Cited

U.S. PATENT DOCUMENTS

| | | | |
|---|---|---|---|
| 948,412 | A | 2/1910 | Buissono |
| 1,012,648 | A | 12/1911 | Karp |
| 1,338,098 | A | 4/1920 | Schneider |
| 1,525,322 | A | 2/1925 | Post |
| 1,784,158 | A | 12/1930 | Place |
| 1,982,845 | A | 12/1934 | Wagman |
| 2,057,713 | A | 10/1936 | Edelson |
| 2,084,173 | A | 6/1937 | Wexler |
| 2,150,171 | A | 3/1939 | Erwin |
| 2,160,682 | A | 5/1939 | Silber |
| 2,170,339 | A | 8/1939 | Reeves |
| 2,264,314 | A | 12/1941 | Johns |
| 2,686,913 | A | 8/1954 | Brierley |
| 2,715,226 | A | 8/1955 | Weiner |
| 2,803,824 | A | 8/1957 | Parish |
| 2,836,828 | A | 6/1958 | Henrikson |
| 3,045,243 | A | 7/1962 | Seymour et al. |
| 3,086,215 | A | 4/1963 | Di Paola |
| 3,153,793 | A | 10/1964 | Lepore |
| 3,296,626 | A | 1/1967 | Ludwikowski |
| 3,496,572 | A | 2/1970 | Benno |
| 3,698,014 | A | 10/1972 | Little et al. |
| 3,706,102 | A | 12/1972 | Grenier |
| 4,034,417 | A | 7/1977 | Ellis |
| 4,170,793 | A | 10/1979 | O'Brien |
| 4,344,999 | A | 8/1982 | Gohlke |
| 4,408,356 | A | 10/1983 | Abrams |
| 4,454,191 | A | 6/1984 | Von et al. |
| 4,513,451 | A | 4/1985 | Brown |
| 4,530,873 | A | 7/1985 | Okada |
| 4,569,874 | A | 2/1986 | Kuznetz |
| 4,665,563 | A | 5/1987 | Harvey |
| 4,722,099 | A | 2/1988 | Kratz |
| 4,756,027 | A | 7/1988 | Buenos et al. |
| 4,810,559 | A | 3/1989 | Fortier et al. |
| 4,868,928 | A | 9/1989 | Norvell |
| 5,035,000 | A | 7/1991 | Matthias |
| D319,113 | S | 8/1991 | Adams |
| 5,097,534 | A | 3/1992 | Viemeister et al. |
| 5,204,156 | A | 4/1993 | Lumb et al. |
| 5,274,850 | A | 1/1994 | Aldridge |
| 5,378,529 | A | 1/1995 | Bourdeau |
| 5,388,270 | A | 2/1995 | Hewitt |
| 5,504,944 | A | 4/1996 | Bromer et al. |
| 5,642,526 | A | 7/1997 | Thompson |
| 5,687,423 | A | 11/1997 | Ross |
| 5,704,064 | A | 1/1998 | Van Der Sleesen |
| 5,727,256 | A | 3/1998 | Rudman |
| 5,752,277 | A | 5/1998 | Van Der Sleesen |
| 5,784,720 | A | 7/1998 | Mellon et al. |
| 5,794,265 | A | 8/1998 | Reich |
| 5,815,837 | A | 10/1998 | Christman et al. |
| 5,845,336 | A | 12/1998 | Golde |
| 5,867,825 | A | 2/1999 | Scheerer |
| 5,913,408 | A | 6/1999 | Shanahan |
| 5,953,758 | A | 9/1999 | Foster |
| 6,070,274 | A | 6/2000 | Van Der Sleesen |
| 6,076,189 | A | 6/2000 | Christman et al. |
| 6,085,353 | A | 7/2000 | Van Der Sleesen |
| 6,122,772 | A | 9/2000 | De Guzman |
| 6,163,883 | A | 12/2000 | Hong |
| 6,253,381 | B1 | 7/2001 | Kelley |
| 6,263,511 | B1 | 7/2001 | Moretti |
| 6,332,221 | B1 | 12/2001 | Gracey |
| 6,339,845 | B1 | 1/2002 | Burns et al. |
| D457,709 | S | 5/2002 | Davis |
| 6,432,504 | B1 | 8/2002 | Yeh |
| 6,449,772 | B1 | 9/2002 | Donner |
| 6,511,927 | B1 | 1/2003 | Ellis et al. |
| 6,654,963 | B2 | 12/2003 | Fayle et al. |
| 6,665,878 | B1 | 12/2003 | Way |
| 6,766,565 | B2 | 7/2004 | Crye et al. |
| 6,874,162 | B2 | 4/2005 | Boezi |
| 6,996,847 | B2 | 2/2006 | Anderson et al. |
| 7,043,766 | B1 | 5/2006 | Foreman et al. |
| 7,168,098 | B2 | 1/2007 | West |
| 7,310,825 | B2 | 12/2007 | St-Germain |
| 7,380,286 | B1 | 6/2008 | Bryant, Sr. |
| 7,418,740 | B2 | 9/2008 | Anderson et al. |
| 7,428,772 | B2 | 9/2008 | Rock |
| 7,540,037 | B1 | 6/2009 | Bittler et al. |
| 7,560,399 | B2 | 7/2009 | Rock et al. |
| 7,568,238 | B2 | 8/2009 | Schossberger et al. |
| 7,682,994 | B2 | 3/2010 | Van et al. |
| 7,779,485 | B2 | 8/2010 | Gandy |
| 7,856,669 | B2 | 12/2010 | Sommers et al. |
| 8,043,240 | B2 | 10/2011 | Piatek |
| 8,133,824 | B2 | 3/2012 | Harber |
| D657,532 | S | 4/2012 | Gaeir et al. |
| 8,187,984 | B2 | 5/2012 | Rock |
| 8,192,824 | B2 | 6/2012 | Rock et al. |
| 8,349,438 | B2 | 1/2013 | Laib et al. |
| 8,438,665 | B2 | 5/2013 | Roemer et al. |
| 8,453,264 | B2 | 6/2013 | Mickle et al. |
| 8,453,270 | B2 | 6/2013 | Blackford |
| 8,454,784 | B2 | 6/2013 | Colasanto et al. |
| 8,479,313 | B2 | 7/2013 | Jones |
| 8,601,612 | B2 | 12/2013 | Funk-Danielson |
| D707,974 | S | 7/2014 | Blackford |
| 8,850,615 | B2 | 10/2014 | Demarest et al. |
| D720,119 | S | 12/2014 | Pankhurst et al. |
| 8,910,313 | B2 | 12/2014 | Gordon et al. |
| 9,009,865 | B2 | 4/2015 | Gilreath |
| 9,032,550 | B2 | 5/2015 | Lambertz |
| 9,060,551 | B2 | 6/2015 | Nordstrom et al. |
| 9,062,913 | B2 | 6/2015 | Araujo et al. |
| 9,090,998 | B2 | 7/2015 | Williams |
| 9,681,689 | B2 | 6/2017 | Horner et al. |
| 10,349,687 | B2 * | 7/2019 | Baschak ..... A41D 31/102 |
| 10,383,382 | B2 | 8/2019 | Horner et al. |
| 10,660,387 | B2 | 5/2020 | Horner et al. |
| 11,317,664 | B2 * | 5/2022 | Horner ..... A41B 7/02 |
| 11,540,571 | B2 | 1/2023 | Horner et al. |
| 11,589,628 | B2 | 2/2023 | Horner et al. |
| 11,839,248 | B2 * | 12/2023 | Horner ..... A41B 1/08 |
| 12,041,993 | B2 * | 7/2024 | Horner ..... A41B 7/02 |
| 2003/0104734 | A1 | 6/2003 | Polegato Moretti |
| 2003/0140404 | A1 | 7/2003 | Golde |
| 2003/0154536 | A1 | 8/2003 | Anderson et al. |
| 2004/0064870 | A1 | 4/2004 | Gold |
| 2004/0132367 | A1 | 7/2004 | Rock |
| 2004/0237168 | A1 | 12/2004 | Braun |
| 2005/0070189 | A1 | 3/2005 | Thiriot |
| 2005/0172378 | A1 | 8/2005 | Messiou |
| 2005/0172381 | A1 | 8/2005 | Bush |
| 2005/0208857 | A1 | 9/2005 | Baron et al. |
| 2005/0273903 | A1 | 12/2005 | Rudman |

(56) References Cited

U.S. PATENT DOCUMENTS

| | | | |
|---|---|---|---|
| 2006/0000005 | A1 | 1/2006 | Foreman et al. |
| 2006/0035555 | A1 | 2/2006 | Narayanan et al. |
| 2006/0101554 | A1 | 5/2006 | St-Germain |
| 2006/0179539 | A1 | 8/2006 | Harber |
| 2006/0223400 | A1 | 10/2006 | Yasui et al. |
| 2006/0277652 | A1 | 12/2006 | Okajima |
| 2007/0093162 | A1 | 4/2007 | Holcombe et al. |
| 2007/0118960 | A1 | 5/2007 | Goodwin |
| 2008/0040832 | A1 | 2/2008 | Bay |
| 2008/0263743 | A1 | 10/2008 | Maurer |
| 2009/0077710 | A1 | 3/2009 | Bay |
| 2009/0144844 | A1 | 6/2009 | Dorr |
| 2009/0144884 | A1 | 6/2009 | Duncan |
| 2010/0043116 | A1 | 2/2010 | Vereen |
| 2011/0119811 | A1 | 5/2011 | Rock et al. |
| 2011/0131704 | A1 | 6/2011 | Hughes |
| 2011/0185482 | A1 | 8/2011 | Godfrey et al. |
| 2011/0225699 | A1 | 9/2011 | Elhamsadat et al. |
| 2011/0239350 | A1 | 10/2011 | Ho et al. |
| 2011/0265242 | A1 | 11/2011 | Lambertz |
| 2011/0296580 | A1 | 12/2011 | Demarest et al. |
| 2012/0114883 | A1 | 5/2012 | Kapur et al. |
| 2012/0174291 | A1 | 7/2012 | Fraze |
| 2012/0178343 | A1 | 7/2012 | Hurd et al. |
| 2012/0210499 | A1 | 8/2012 | Habash et al. |
| 2012/0233738 | A1 | 9/2012 | Blauer et al. |
| 2012/0276332 | A1 | 11/2012 | Conolly et al. |
| 2013/0230688 | A1 | 9/2013 | Wu |
| 2013/0269082 | A1 | 10/2013 | Bramblet |
| 2014/0004295 | A1 | 1/2014 | Kiederle |
| 2014/0007314 | A1 | 1/2014 | Davis et al. |
| 2014/0059736 | A1 | 3/2014 | McCuaig |
| 2014/0087104 | A1 | 3/2014 | Kierderle et al. |
| 2014/0090144 | A1 | 4/2014 | Gilreath |
| 2014/0157482 | A1 | 6/2014 | Blauer et al. |
| 2014/0189935 | A1 | 7/2014 | Tucker |
| 2014/0250565 | A1 | 9/2014 | Willows et al. |
| 2014/0259268 | A1 | 9/2014 | Fier |
| 2014/0259276 | A1 | 9/2014 | Fier |
| 2014/0304896 | A1 | 10/2014 | Nordstrom et al. |
| 2014/0338092 | A1 | 11/2014 | Kinsey |
| 2014/0373248 | A1 | 12/2014 | Demarest et al. |
| 2015/0033451 | A1 | 2/2015 | Bradshaw |
| 2015/0104604 | A1 | 4/2015 | Rock et al. |
| 2015/0106992 | A1 | 4/2015 | Blakely et al. |
| 2015/0351458 | A1 | 12/2015 | Fisher et al. |
| 2016/0242469 | A1 | 8/2016 | Horner et al. |
| 2016/0242474 | A1 | 8/2016 | Baschak et al. |
| 2016/0302502 | A1 | 10/2016 | Beneyto-Ferre |
| 2017/0119073 | A1 | 5/2017 | Horner et al. |
| 2017/0215501 | A1 | 8/2017 | Horner et al. |
| 2019/0335829 | A1 | 11/2019 | Horner et al. |
| 2019/0380407 | A1 | 12/2019 | Horner et al. |
| 2020/0237038 | A1 | 7/2020 | Horner et al. |
| 2022/0211131 | A1 | 7/2022 | Horner et al. |
| 2023/0107724 | A1 | 4/2023 | Horner et al. |

FOREIGN PATENT DOCUMENTS

| | | | |
|---|---|---|---|
| WO | 2012/085454 | A1 | 6/2012 |
| WO | 2015/034722 | A1 | 3/2015 |
| WO | 2015/131913 | A1 | 9/2015 |
| WO | 2016/134159 | A1 | 8/2016 |
| WO | 2018/132630 | A1 | 7/2018 |

OTHER PUBLICATIONS

International Search Report and Written Opinion dated Nov. 15, 2016 for International Patent Application No. PCT/US2016/047076, 13 pages.

International Search Report and Written Opinion received for PCT Patent Application No. PCT/US16/018708, mailed on Aug. 3, 2016, 18 pages.

International Search Report and Written Opinion received for PCT Patent Application No. PCT/US16/047077, mailed on Nov. 15, 2016, 14 pages.

International Search Report and Written Opinion received for PCT Patent Application No. PCT/US16/055100, mailed on Nov. 16, 2016, 13 pages.

Non-Final Office Action received for U.S. Appl. No. 18/076,720, mailed on Nov. 29, 2023, 10 pages.

European Search Report and Search Opinion received for European Application No. 23217877.2, mailed on Mar. 6, 2024, 7 pages.

Notice of Allowance received for U.S. Appl. No. 18/076,720, mailed on Mar. 22, 2024, 8 pages.

Office Action received for European Application No. 20764895.7, mailed on May 6, 2024, 5 pages.

"Cyclic Zip Neck Women's," Arc'Teryx, arcteryx, (copyright) 2015, accessed: Aug. 2015. http://arcteryx.com/product.aspx?language=EN&gender=womens&category=shirts_and_tops&model=Cyclic-Zip-Neck-W.

"Trans4m (trademark) Thermal Plus (trademark) Run Glove," Amphipod, Inc., amphipod.com, (copyright) 2015, accessed: Aug. 2015. http://www.amphipod.com/products/trans4m-thermal-plus-run-glove.

Allen, Dana, "Mountain Equipment Eclipse Hooded Zip Tee", blister, blistergearreview.com, Available on Internet at: <http://blistergearreview.com/gear-reviews/mountain-equipment-eclipse-hooded-zip-tee>, Oct. 4, 2013, 3 pages.

Debra, Kitsilano, "Lululemon Pumpkin Orange Long Sleeve Turkey Trot Technical Running Shirt Top 205", goodoldlululemon.wordpress.com, Available on Internet at: <hllps://goodoldlululemon.wordpress.com/2013/02/08/ululemon-pumpkin---orange-long-sleeve-turkey-trot-technical-running- shirt-top-205/>, Feb. 8, 2013, 8 pages.

Extended European Search Report received for European Patent Application No. 21180720.1, dated Nov. 17, 2021, 11 pages.

International Search Report and Written Opinion dated Mar. 27, 2018 in International Patent Application No. PCT/US2018/013437, 14 pages.

International Search Report and Written Opinion Dated May 19, 2016 for PCT Application No. PCT/US2016/018493, 10 pages.

International Search Report and Written Opinion received for PCT Patent Application No. PCT/US2020/047104, dated Oct. 26, 2020, 10 pages.

Johnson, J_ J., "Ortovox Merino Fleece Hoody", YMMV Reviews, Available on Internet at: <http://ymmvreviews.com/ clothing/ortovox-merino-fleece-hoody/>, Accessed on Aug. 9, 2015, 7 pages.

Final Office Action received for U.S. Appl. No. 18/243,237, mailed on Oct. 30, 2024, 20 pages.

Non-Final Office Action received for U.S. Appl. No. 18/243,237, mailed on Jul. 15, 2024, 22 pages.

Notice of Allowance received for U.S. Appl. No. 18/076,720, mailed on Jun. 17, 2024, 3 pages.

* cited by examiner

LAYERED THUMBHOLE STRUCTURE

CROSS-REFERENCE TO RELATED APPLICATIONS

This application, entitled "Layered Thumbhole Structure," is a continuation of U.S. Nonprovisional application Ser. No. 17/704,965, filed Mar. 25, 2022, and entitled "Layered Thumbhole Structure," which is a divisional application of U.S. Nonprovisional application Ser. No. 16/512,058, filed Jul. 15, 2019, and entitled "Layered Thumbhole Structure," now issued as U.S. Pat. No. 11,317,664, which is a continuation application of U.S. Nonprovisional application Ser. No. 15/493,468, filed Apr. 21, 2017, and entitled "Layered Thumbhole Structure," now issued as U.S. Pat. No. 10,383,382 on Aug. 20, 2019, which is a continuation application of U.S. Nonprovisional application Ser. No. 15/045,465, filed Feb. 17, 2016, and entitled "Layered Thumbhole Structure," now issued as U.S. Pat. No. 9,681,689 on Jun. 20, 2017, which claims priority to U.S. Provisional Application No. 62/242,760 filed Oct. 16, 2015, and entitled "Layered Thumbhole Structure." and further claims priority to U.S. Provisional Application 62/118,288, filed Feb. 19, 2015, and entitled "Adaptive Material Garment System," The entireties of the aforementioned applications are incorporated by reference herein.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

At a high level, aspects described herein are directed towards a sleeve cuff having a thumbhole aperture formed between overlapping panels that can block, among other things, undesirable air flow into a sleeve when the aperture is not in use. The sleeve cuff is comprised of a distal panel (also referred to below as a distal strap) overlapping an anterior panel (also referred to below as an anterior patch). In an exemplary configuration, the distal panel and the anterior panel are affixed to a sleeve adjacent to, and covering at least a portion of, a cutout formed in the sleeve. The distal panel can span across the cutout and extend from a front edge (also referred to below as a leading edge) aligned with the end of the sleeve proximally up the sleeve to a back edge (also referred to below as a trailing edge). The anterior panel can be configured to cover at least a portion of the cutout. The anterior panel can include a back edge (also referred to as a trailing edge) and extend down the sleeve to a front edge (also referred to as a leading edge). For relational purposes, it is contemplated that the distal panel is affixed farther down the sleeve than the anterior panel.

It is contemplated that the configuration of the distal panel and the anterior panel can change, depending on whether the aperture is in an opened configuration (e.g., due to insertion of a thumb) or in a closed configuration, as will be described herein in more detail. In a closed configuration, the distal panel overlaps a portion of the anterior panel such that the distal panel back edge is located proximally up the sleeve from the anterior panel front edge. It is contemplated that either the anterior panel or the distal panel may be on top of the other at the overlapping portion. When in the closed configuration, permeability to the elements can be dramatically reduced. When in an opened configuration, the distal panel back edge overlaps a portion of the anterior panel (moving laterally across the anterior panel) between a first anterior panel side edge and a first point of intersection, and between a second anterior panel side edge and a second point of intersection. The first and second points of intersection refer to the intersections between the anterior panel front edge and the distal panel back edge. It is this offset design that provides a snug fit around a thumb that reduces air and environmental permeability when a thumb is received. In this open configuration, the anterior panel front edge is separated from the distal panel back edge and the aperture forms a snug fit around a received thumb between the first point of intersection and the second point of intersection. The perimeter of the aperture comprises a portion of the anterior panel front edge and a portion of the distal panel back edge.

Aspects described herein may further relate to a method of manufacturing a sleeve having a sleeve cuff in accordance with aspects described herein. In an exemplary aspect, the method may comprise the steps of providing a sleeve, providing an anterior panel, and providing a distal panel. The sleeve has a first end distally located from a torso end and having a hand opening thereat. The sleeve further comprises a cutout formed in a wall of the sleeve. In one aspect, the cutout has one or more edges. The distal panel has a back edge and at least one front edge. The anterior panel has a front edge and one or more back edges. The method further comprises the step of affixing the distal panel to the sleeve such that the distal strap spans the cutout. In one aspect, a distal panel front edge is aligned with the end of the sleeve. The method further comprises the step of affixing the anterior panel to the sleeve at the one or more back edges such that the anterior panel covers at least a portion of the cutout in the sleeve and such that the distal panel back edge overlaps at least a portion of the anterior panel. The overlapping distal panel and anterior panel present an aperture. The aperture has a perimeter comprised of at least a portion of the distal panel and at least a portion of the anterior panel. The method may further comprise the step of forming a cutout in the sleeve.

BRIEF DESCRIPTION OF THE DRAWINGS

Examples of the present invention are described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed, unless and except when the order of individual steps is explicitly stated.

The terms of location used in this disclosure related to a sleeve extending from a torso portion of an article of apparel shall have their traditional meanings. A point on the sleeve is proximal to a second point if it is farther up the sleeve (e.g., closer to the torso portion) in the axial direction of sleeve extension. A point on the sleeve is distal to a second point if it is farther down the sleeve (e.g., farther from the torso portion) in the axial direction of sleeve extension. The location term "lateral" as used in connection with the sleeve may include a planar direction normal to the axial direction of sleeve extension.

The terms "overlap," "overlaps," or "overlapping" (etc.) when used in this disclosure (e.g., "the distal strap overlaps the anterior patch") include both overlapping "on top of" and "beneath." In terms of the example, the distal strap may overlap the anterior patch such that the distal strap overlaps on top of the anterior patch or the distal strap may overlap the anterior patch such that the distal strap overlaps beneath the anterior patch.

Figure 1:
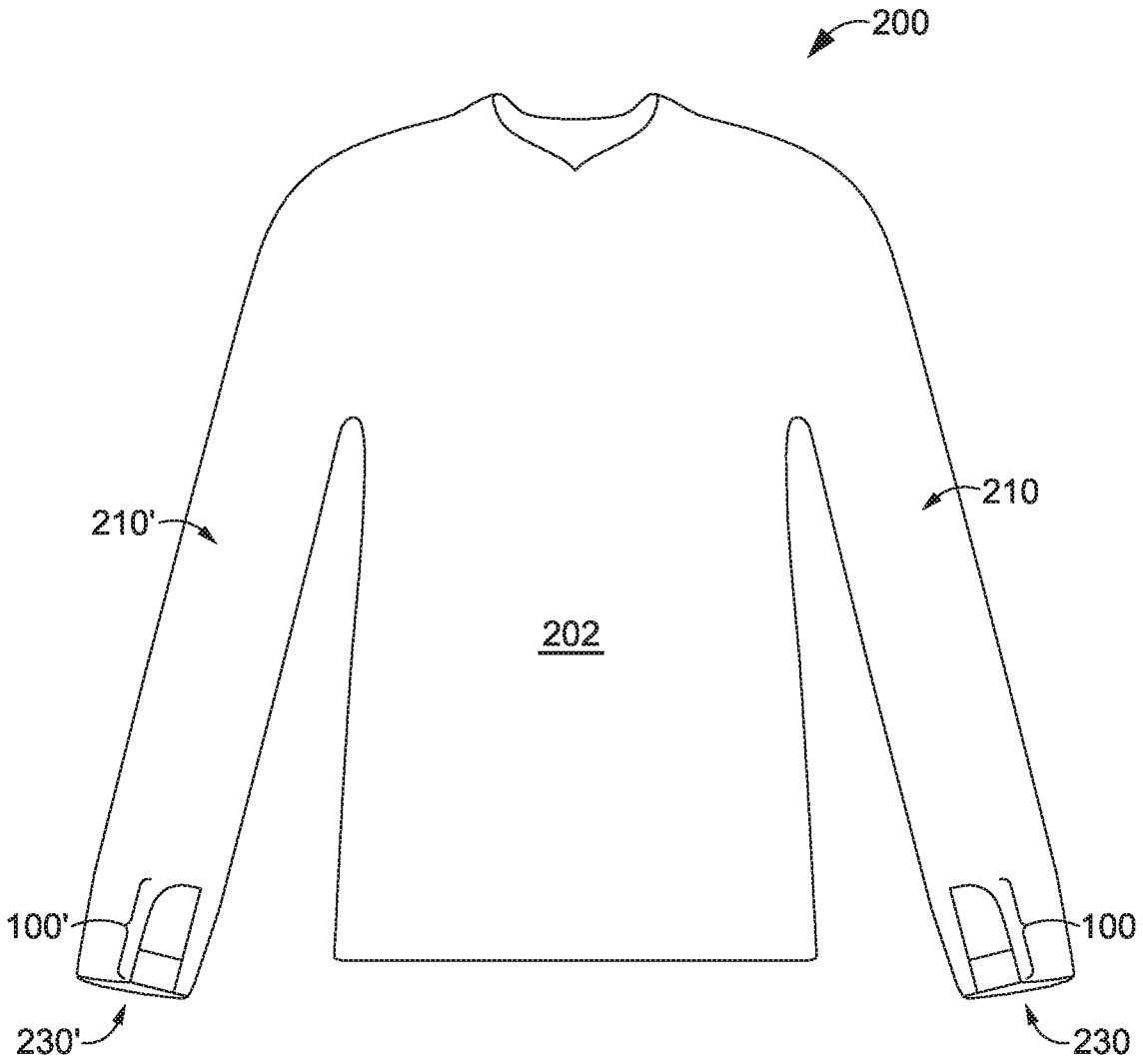
FIG. 1 illustrates a front elevation view of an exemplary article of apparel having sleeve cuffs affixed to distal sleeve ends on the article in accordance with an aspect described herein.

Turning now to FIG. 1, illustrated is a shirt 200 having a torso portion 202, a left sleeve 210, a right sleeve 210', each of the sleeves 210 and 210' extending distally away from the torso portion 202 each sleeve includes a proximal end attached to the torso portion 202 and terminating at distal sleeve ends 230 and 230', respectively, wherein for each sleeve, the proximal end is located longitudinally opposite form the distal end. Each sleeve may include a sleeve cuff 100 and 100', respectively, as depicted in FIG. 1. It is to be understood that the remaining disclosure describes the sleeve cuff 100 in relation to the left sleeve 210 and the distal sleeve end 230. As understood by those having skill in the art, however, this disclosure equally applies to the sleeve cuff 100' in relation to the right sleeve 210' and the distal sleeve end 230'. The remainder of this disclosure shall reference a sleeve 210.

Figure 2A:
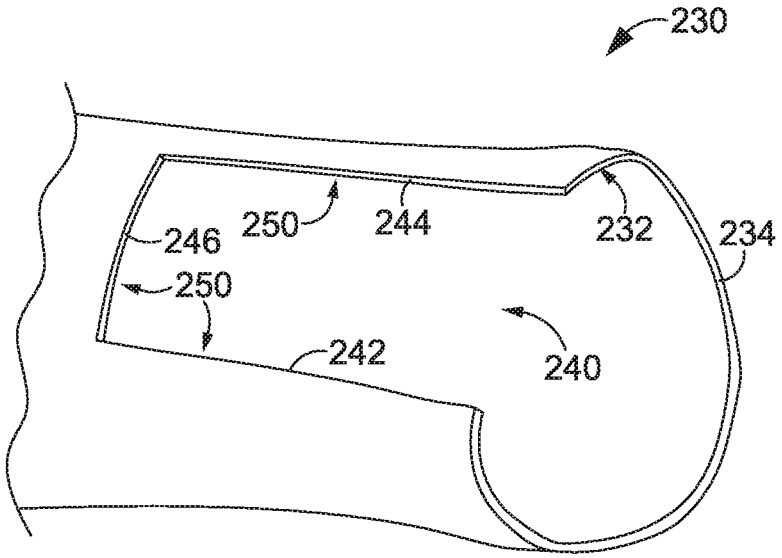
FIG. 2A illustrates a detail view of a distal sleeve end without a sleeve cuff affixed thereto in accordance with an aspect described herein.
Figure 2B:
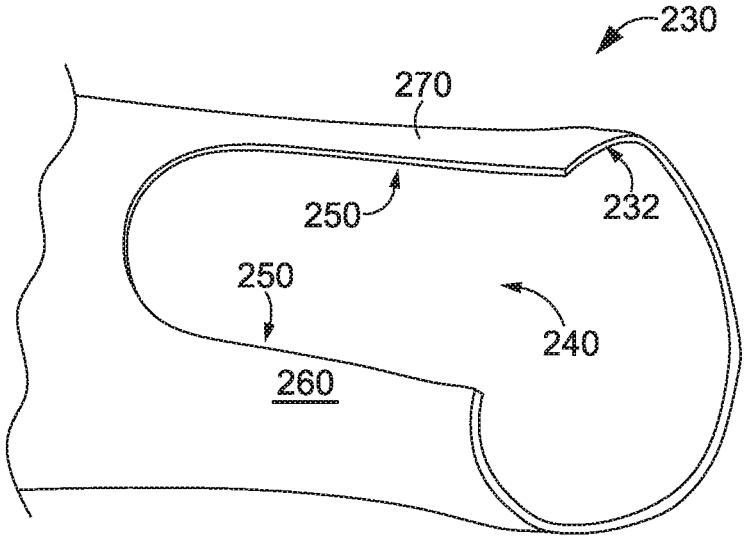
FIG. 2B illustrates a detail view of an alternative distal sleeve end without a sleeve cuff affixed thereto in accordance with an aspect described herein.

FIG. 2A depicts a distal sleeve end 230 of the sleeve 210 without the sleeve cuff 100 affixed thereto. The distal sleeve end 230 comprises a sleeve wall 232 extending proximally up the sleeve from a distal edge 234. The sleeve wall 232 includes a cutout 240 formed therein. The cutout 240 may extend from the distal edge 234 proximally up the sleeve 210. The cutout 240 further comprises at least one cutout edge 250. The at least one cutout edge 250 may comprise a first cutout edge 242, a second cutout edge 244, and a rear cutout edge 246 as depicted in FIG. 2A. The distal sleeve end 230 further comprises a first outer surface 260 and a second outer surface 270 (as illustrated in FIG. 2B), each outer surface being located adjacent to the cutout 240. In some aspects, the first cutout edge 242, the second cutout edge 244, and the rear cutout edge 246 may be a single edge comprising the at least one cutout edge 250.

In another aspect, the cutout 240 may be formed proximally up the sleeve 210 from the distal edge 234. In this aspect, the cutout 240 comprises a hole formed in the sleeve wall 232 and the cutout 240 is bounded by the sleeve wall 232 on all sides. In this aspect, the at least one cutout edge 250 may further comprise a front cutout edge. The front cutout edge and the distal edge 234 form a margin at the distal sleeve end 230.

In another aspect illustrated in FIG. 2B, the distal sleeve end 230 includes a cutout 240 formed in a sleeve wall 232. The cutout 240 extends proximally up the sleeve 210 and includes the at least one cutout edge 250. Spaced apart by the cutout 240 are the first outer surface 260 and the second outer surface 270.

Figure 3:
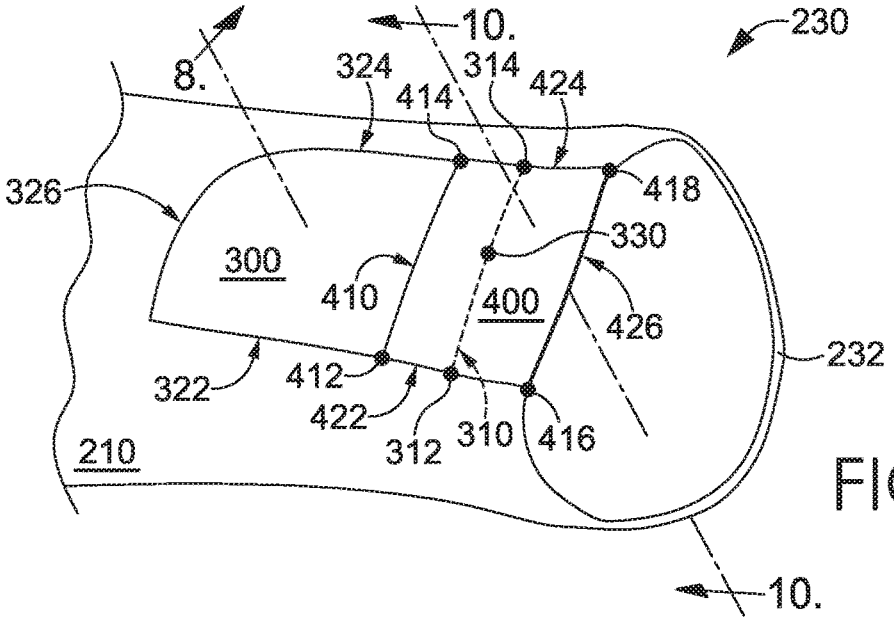
FIG. 3 illustrates a detail view of a sleeve cuff in a closed configuration in accordance with an aspect described herein.
Figure 4:
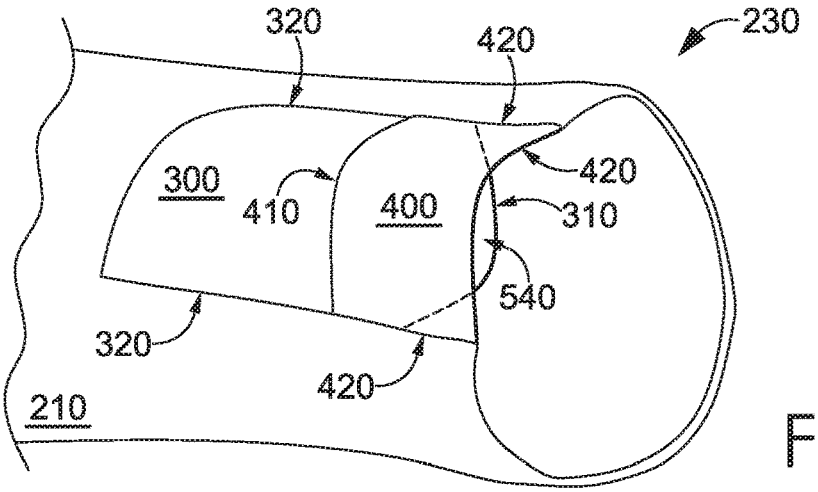
FIG. 4 illustrates a detail view of a sleeve cuff with a distal strap and an anterior patch separated while in the closed configuration in accordance with an aspect described herein.
Figure 5:
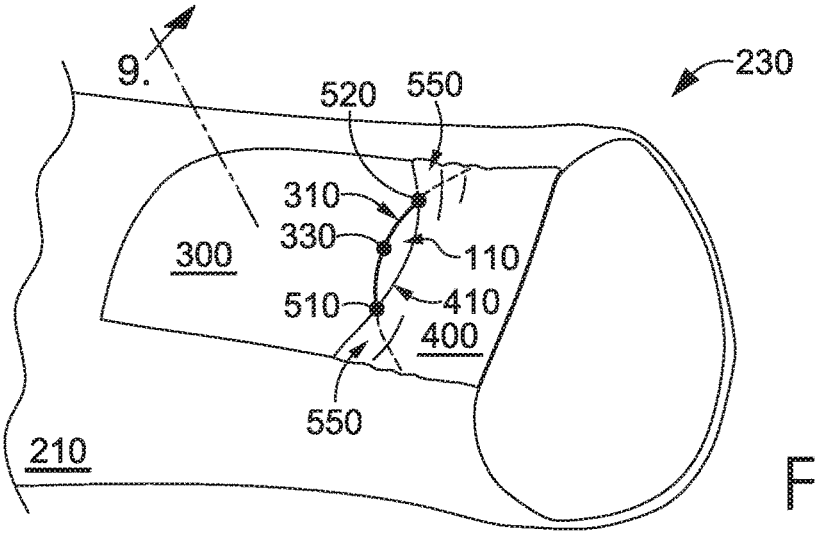
FIG. 5 illustrates a detail view of a sleeve cuff in an opened configuration in accordance with an aspect described herein.

Referring now to FIGS. 3-5, the sleeve cuff 100 further comprises an anterior patch 300 affixed to the sleeve 210. The anterior patch 300 is shown having a leading edge 310 and a plurality of trailing edges 320. In another aspect, the anterior patch 300 may have a leading edge 310 and a single trailing edge extending from one side to the other side of the leading edge 310, the anterior patch 300 extending there-between. The leading edge 310 extends laterally across the cutout 240 from a first anchor point 312 associated with the first outer surface 260 to a second anchor point 314 associated with the second outer surface 270. In another aspect, the leading edge 310 may extend between a first anchor point 312 associated with a first cutout edge 242 to a second anchor point 314 associated with a second cutout edge 244. The anterior patch leading edge 310 is spaced away from the distal end of the sleeve in a direction toward the proximal end of the sleeve. The plurality of trailing edges 320 are located proximally up the sleeve from the leading edge 310, and the anterior patch 300 extends there-between. In the aspect illustrated by FIG. 3, the plurality of trailing edges includes a first side edge 322, a second side edge 324, and a rearward edge 326.

The anterior patch 300 may be affixed to the sleeve 210 atop or below the sleeve wall 232, within the cutout 240 to the at least one cutout edge 250 or in combination thereof. In another aspect, at least one first seam may affix the anterior patch 300 to the sleeve 210. In one aspect, the anterior patch 300 is affixed to the sleeve 210 from the first anchor point 312 around the cutout 240 located proximally to the leading edge 310 at each of the plurality of trailing edges 320 and to the second anchor point 314. In the aspect illustrated by FIG. 3, the anterior patch 300 is affixed adjacent to the rear cutout edge 246 at the rearward edge 326. As further illustrated in FIG. 3, the anterior patch 300 extends distally down the sleeve 210 from the rearward edge 326 to the leading edge 310 and the first and second side edges 322 and 324 are affixed adjacent to the first and second cutout edges 242 and 244, respectively, from the rearward edge 326 to the first and second anchor points 312 and 314, respectively. In one aspect, the anterior patch 300 may cover at least a portion of the cutout 240. The term "cover" is not meant to imply a limitation that the anterior patch 300 must be atop the sleeve 210; to the contrary, the anterior patch 300 may be atop or below the sleeve 210 or within the cutout 240 and prevent communication through the portion of the cutout 240 that is "covered."

The sleeve cuff 100 further comprises a distal strap 400. In one aspect, the distal strap 400 includes a trailing edge 410 and a plurality of leading edges 420 and extends there-between. In another aspect, the distal strap 400 may include a trailing edge 410 and a single leading edge. In the aspect illustrated in FIG. 3, the plurality of leading edges 420 include a first side edge 422, a second side edge 424, and a front edge 426, the front edge 426 being parallel to the trailing edge 410. In one aspect, the trailing edge 410 extends across the cutout 240 from a first anchor point 412 to a second anchor point 414. In the aspect depicted in FIG. 3, the front edge 426 extends laterally across the cutout 240 from a third anchor point 416 to a fourth anchor point 418. In any aspect depicted in FIG. 3, the distal strap 400 spans the cutout 240 and is affixed to the sleeve 210 such that the first side edge 422 is affixed to the first outer surface 260 and the second side edge 424 is affixed to the second outer surface 270. The distal strap 400 may be oriented to have a long length dimension extend laterally around the sleeve and a short width dimension extend axially up the sleeve. In the aspect illustrated in FIG. 3, the front edge 426 is not affixed to the sleeve 210. In this aspect, the front edge 426 may be laterally aligned with the distal edge 234. In another aspect, where the cutout 240 may be spaced proximally up the sleeve 210 from the distal edge 234, the front edge 426 may be affixed to the sleeve 210 adjacent to the forward cutout edge.

The exemplary distal strap 400 illustrated in FIG. 3 extends laterally across the cutout 240 between the first side edge 422 and the second side edge 424 and proximally up the sleeve 210 from the front edge 426 to the trailing edge 410. In the illustrated aspect, the sleeve cuff 100 is in a closed configuration and the distal strap trailing edge 410 is proximally located up the sleeve from the anterior patch leading edge 310; stated another way, the distal strap 400 overlaps the anterior patch 300.

The distal strap 400 may be affixed atop the sleeve 210, below the sleeve 210, within the cutout 240, or in some combination thereof. In one aspect, the distal strap 400 is affixed to the distal sleeve end 230 at the first outer surface 260 and the second outer surface 270. In another aspect, the at least one first seam may affix the distal strap 400 to the sleeve 210. In yet another aspect, a second seam may affix the distal strap 400 to the sleeve 210. In one aspect, the distal strap 400 is affixed to the sleeve 210 along the first side edge 422 from the first anchor point 412 to the third anchor point 416 and along the second side edge 424 from the second anchor point 414 to the fourth anchor point 418.

When the shirt 200 is in the as-worn position (i.e., when the shirt 200 is donned by a wearer), the sleeve cuff 100 presents a plurality of configurations. In one aspect, the plurality of configurations includes at least the closed configuration and an opened configuration. The closed configuration is best seen in FIG. 3. The opened configuration may be seen in FIGS. 6-8. In one aspect, the closed configuration is defined by the distal strap 400 overlapping the anterior patch 300 such that the distal strap trailing edge 410 is located proximally up the sleeve 210 from the anterior patch leading edge 310. The closed configuration is typically presented when the sleeve is in the as-worn position and a thumb is not received through the aperture 110.

One aspect of the open configuration illustrated in FIG. 5 includes the aperture 110 presented between a first point of intersection 510 and a second point of intersection 520. The points of intersection 510 and 520 are defined by the points where the distal strap trailing edge 410 intersects the anterior patch leading edge 310.

In the aspect illustrated in FIG. 5, when the sleeve cuff 100 is in the open configuration, the sleeve cuff 100 may include an overlapping portion 550 where the distal strap 400 overlaps the anterior patch 300 between the first cutout edge 242 and the first point of intersection 510. The sleeve cuff 100 in the open configuration further includes the aperture 110 between the first point of intersection 510 and the second point of intersection 520. In one aspect, a perimeter of the aperture 110 is comprised of a portion of the distal strap trailing edge 410 and a portion of the anterior patch leading edge 310. The sleeve cuff 100 in the open configuration may further include a second overlapping portion where the distal strap 400 overlaps the anterior patch 300 between the second point of intersection 520 and the second cutout edge 244.

FIG. 4 depicts the exemplary sleeve cuff 100 of FIG. 3 with the distal strap 400 and the anterior patch 300 separated while still in the closed configuration in accordance with an aspect hereof. As can be understood, the separation of the anterior patch 300 and distal strap 400 in the manner depicted in FIG. 4 does not provide a hole through which a user's thumb may extend as a thumb will extend along the inner surface of the anterior patch 300 past the trailing edge 410 of the distal strap 400 which prevents, based on traditional human anatomy, the thumb from accidentally extending through the aperture 110, in an exemplary aspect. Therefore, a gap 540 may be formed between the distal strap 400 and the anterior patch 300 without eliminating an overlap near the midpoint of the leading edge 310.

FIG. 5 depicts the sleeve cuff 100 in an open configuration at the aperture 110 in accordance with aspects described herein. In this example, a center point 330 is not overlapped by the distal strap 400. The leading edge 310 is overlapped by the distal strap 400 trailing edge 410 near the first and second side edges 322 and 324. However, the leading edge 310 intersects the trailing edge 410, at the first and second points of intersection 510 and 520, causing the center point 330 to be spaced apart from the distal strap 400 and to form the aperture 110. Stated differently, it is contemplated that the aperture 110 is defined by the leading edge 310 and the trailing edge 410 between a first point of intersection 510 and a second point of intersection 520 of the same edges.

The perimeter of the aperture 110 may include at least a portion of the leading edge 310 and at least a portion of the trailing edge 410.

Figure 6:
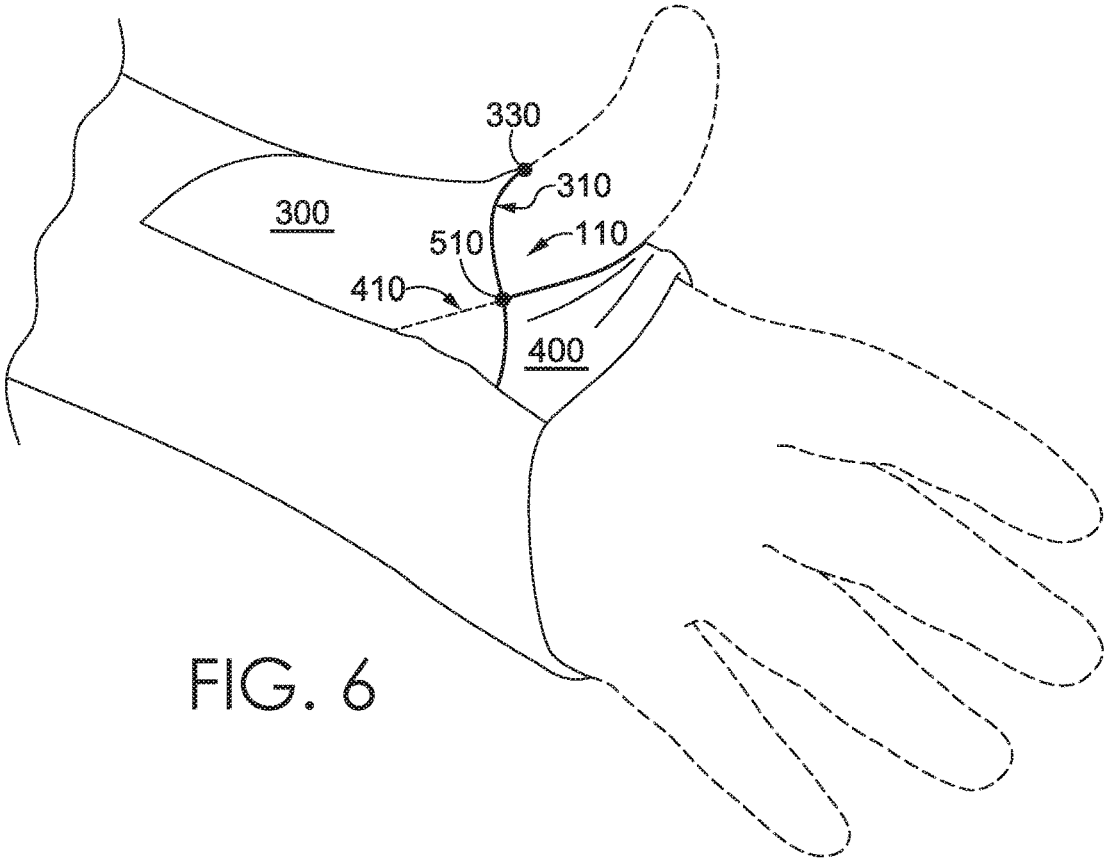
FIG. 6 illustrates a detail view of a sleeve cuff having a thumb extending through an aperture in accordance with an aspect described herein.

FIG. 6 illustrates an alternative aspect of the present invention where the anterior patch 300 overlaps the distal strap 400 on the exterior side of the sleeve 210 (from FIG. 3). Hence, when viewed from outside the sleeve 210, the anterior patch 300 is on top of the distal strap 400 where the items overlap.

Figure 7:
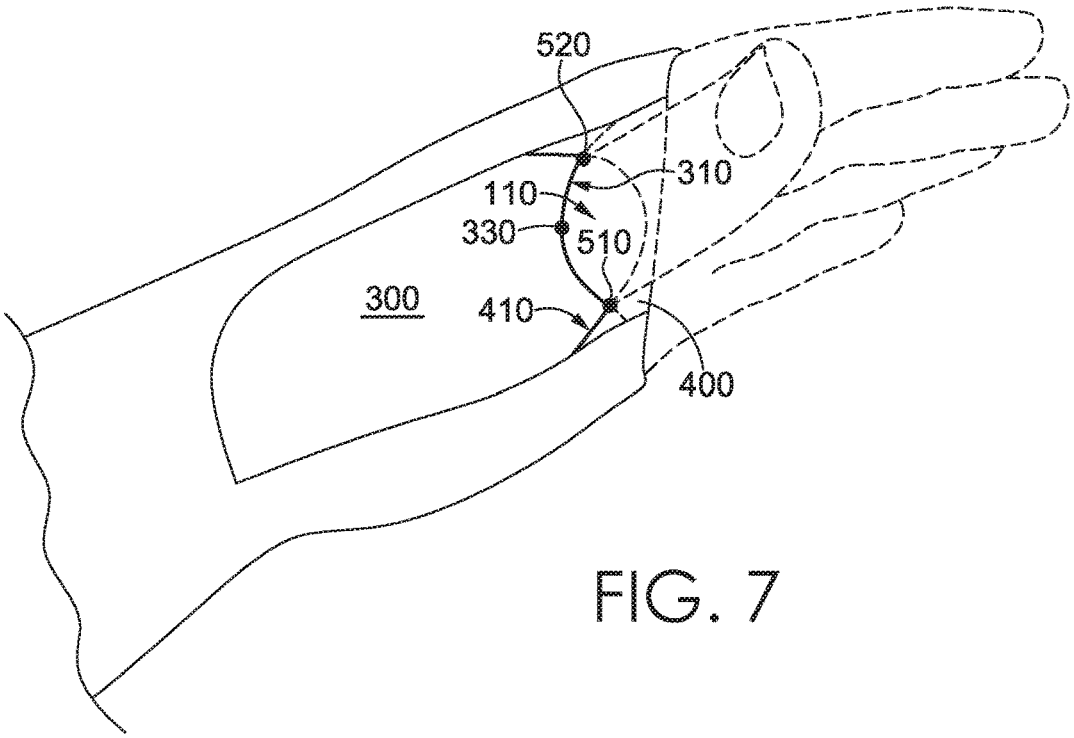
FIG. 7 illustrates a detail view of a sleeve cuff having a thumb extending through an aperture in accordance with an aspect described herein.

FIG. 6 and FIG. 7 depict the sleeve cuff 100 in the open configuration and having a thumb received through the aperture 110 in accordance with aspects described herein. As can be illustrated with a thumb extending therethrough, the aperture 110 is formed, in an exemplary aspect, by the leading edge 310 extending radially outward from an axial centerline of the sleeve 210 when in the open configuration. To facilitate transitioning from a closed to an open configuration, and to allow for freedom of movement of the thumb, it is contemplated that the distal strap 400 and/or the anterior patch 300 are formed from an elastic material that allows for the manipulation of the trailing edge 410 and the leading edge 310 to open and move about a thumb.

Varying the materials used to form the distal strap 400 and/or the anterior patch 300 may provide for additional control of the elasticity provided at the distal sleeve end 230. In one aspect, the distal strap 400 and/or the anterior patch 300 may be comprised of a woven material. In another aspect, the distal strap 400 and/or the anterior patch 300 may be comprised of an engineered knit material. In some aspects, the sleeve 210 can be comprised of materials having lower elasticity than the materials in the sleeve cuff 100. In those aspects, including the sleeve cuff 100 in the sleeve 210 allows the wearer to pull the sleeve 210 up their arm such that the distal sleeve end 230 is positioned proximally up the wearer's arm. Further, the net elasticity of the distal sleeve end 230 and the sleeve cuff 100 may be operable to hold the distal sleeve end 230 at the proximally located position of the wearer's arm.

Figure 8:
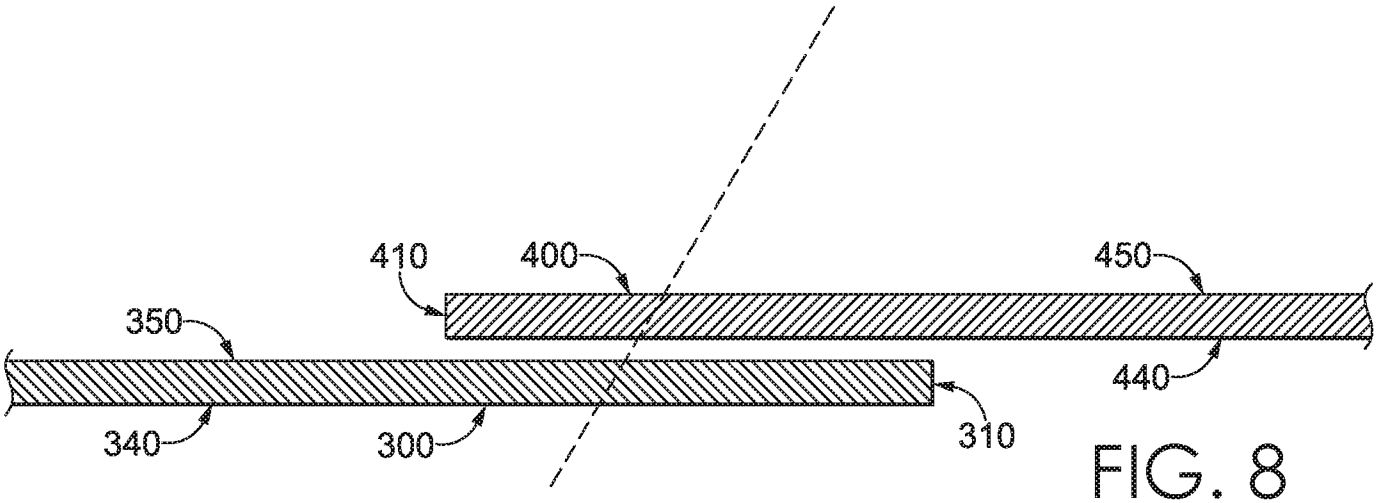
FIG. 8 depicts a cross-section taken along 8-8 of FIG. 3 and illustrates a sleeve cuff in a closed configuration in accordance with an aspect described herein.

FIG. 8 depicts a cross-section of a sleeve cuff 100 in a closed configuration, in accordance with aspects described herein. The distal strap 400 is comprised of an inner surface 440 and an outer surface 450. The anterior patch 300 is comprised of an inner surface 340 and an outer surface 350. As depicted, the distal strap 400 trailing edge 410 overlaps the anterior patch 300. A dash line is provided to depict an exemplary angle of thumb insertion to open the thumbhole by changing the relative placement of the trailing edge 410 relative to the leading edge 310 as depicted in FIG. 9.

Figure 9:
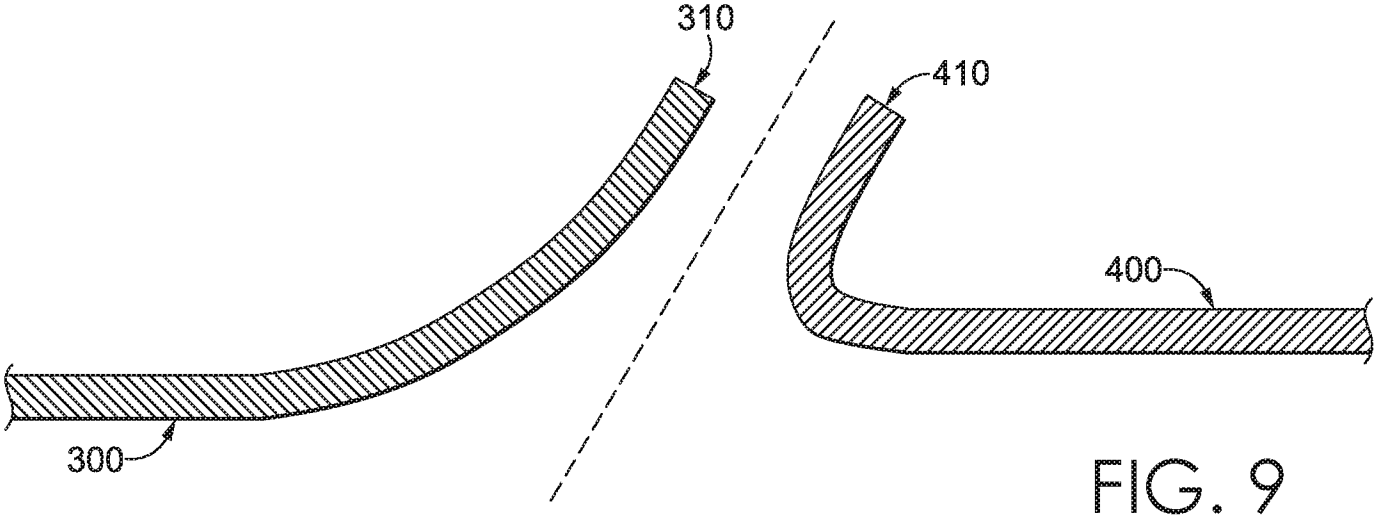
FIG. 9 depicts a cross-section taken along 9-9 of FIG. 5 and illustrates a sleeve cuff in an opened configuration in accordance with an aspect described herein.

FIG. 9 depicts a cross-section of the sleeve cuff 100 in the opened configuration, in accordance with aspects described herein. The open configuration allows a thumb having an angle of entry depicted by the dash line to exit an internal volume of the sleeve 210.

The sleeve cuff 100 has hereinabove been disclosed as having the distal strap 400 overlapping the anterior patch 300. It is contemplated, however, that in one exemplary aspect the anterior patch 300 overlaps the distal strap 400. In this aspect, the anterior patch leading edge 310 overlaps the distal strap and is distally located down the sleeve 210 from the distal strap trailing edge 410. This aspect further comprises the aperture 110 formed between the overlapping anterior patch 300 and distal strap 400 and having a perimeter including at least a portion of each of the leading edge 310 and the trailing edge 410.

Figure 10:
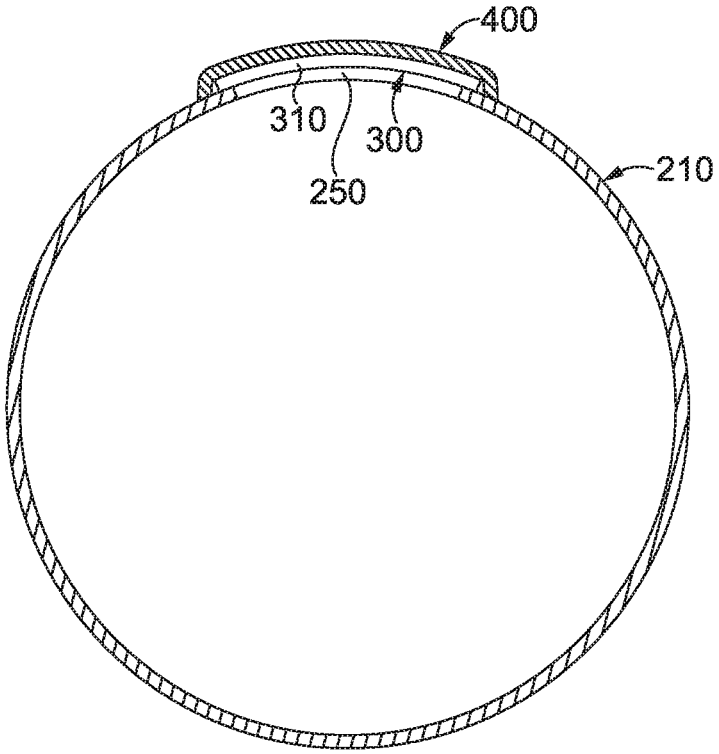
FIG. 10 depicts a cross-section taken along 10-10 of FIG. 3 and illustrates a sleeve cuff affixed to sleeve surfaces on opposite sides of a cutout and in a closed configuration in accordance with an aspect described herein.

FIG. 10 depicts a lateral cross-section of the sleeve cuff 100 across line 10-10 in FIG. 3, the line 10-10 being coplanar with the anterior patch leading edge 310. The distal strap 400 is shown overlapping the anterior patch 300 and the sleeve cuff 100 is in the closed configuration. It is understood that the anterior patch 300 is affixed at the inner surface 340 to the sleeve wall 232 at the first and second outer surfaces 260, 270. Further, it is understood that the distal strap 400 is similarly affixed at the distal strap inner surface 440 to the sleeve wall 232 at the first and second outer surfaces 260, 270.

Figure 11:
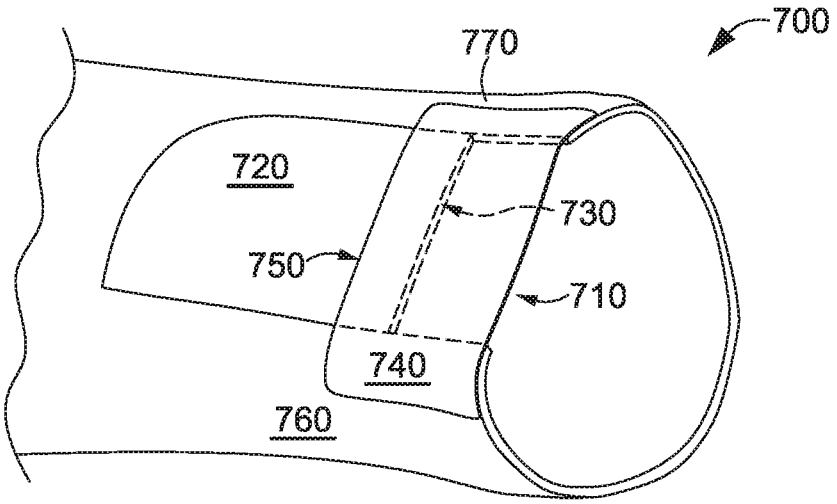
FIG. 11 illustrates a detail view of a sleeve cuff with a distal strap affixed to sleeve surfaces on opposite sides of a cutout and an anterior patch affixed within the cutout to opposing cutout edges and in a closed configuration in accordance with an aspect described herein.

FIG. 11 depicts another aspect of the distal sleeve end 700 in a closed configuration in accordance with an aspect hereof. Depicted is a distal sleeve end 700 having a cutout 710. The cutout 710 includes an anterior patch 720 affixed around and adjacent to the cutout 710 at the points proximally located up the sleeve from a leading edge 730. The distal sleeve end 700 further includes a distal strap 740 having a trailing edge 750, the distal strap 740 being affixed at a first sleeve surface 760 and a second sleeve surface 770. The trailing edge 750 is located proximally up the sleeve from the anterior patch leading edge 730. As depicted, the distal strap 740 is wider than the cutout 710 and is also wider than the anterior patch 720. In one aspect, the distal strap 740 is affixed to the sleeve on both sides of the cutout 710 but not at points adjacent to the cutout 710. In another aspect, the sleeve integrates the anterior patch 720 therein such that the leading edge 730 forms a rear wall of the cutout 710. In this aspect, the distal strap trailing edge 750 is proximally located up the sleeve from the integral leading edge 730. In yet another aspect, the distal strap 740 may be similarly integrated into the distal sleeve end 700 and the anterior patch 720 is affixed to the sleeve such that the integral trailing edge 750 overlaps the anterior patch leading edge 730.

Figure 12:
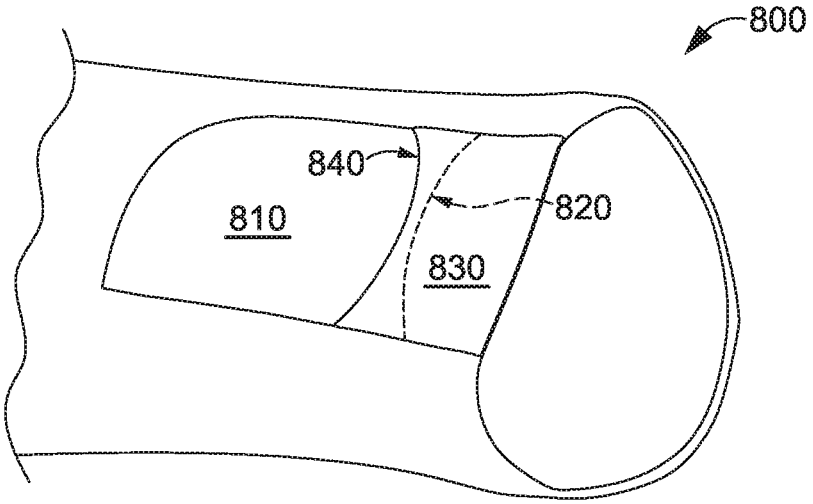
FIG. 12 illustrates a detail view of a sleeve cuff with an angular distal strap trailing edge and an angular anterior patch leading edge in accordance with an aspect described herein.

FIG. 12 depicts a distal sleeve end 800 in a closed configuration having an anterior patch 810 and a distal strap 830 affixed over a cutout. In one aspect, the distal strap 830 includes a trailing edge 840 having an arcuate shape. In this aspect, the anterior patch 810 has a leading edge 820 having an arcuate shape. The distal strap 830 may be positioned such that the distal strap 830 overlaps the anterior patch 810 and the arcuate trailing edge 840 is positioned proximally up the sleeve from the arcuate leading edge 820 and there are no points of intersection between the arcuate trailing edge 840 and the arcuate anterior leading edge 820.

Figure 13:
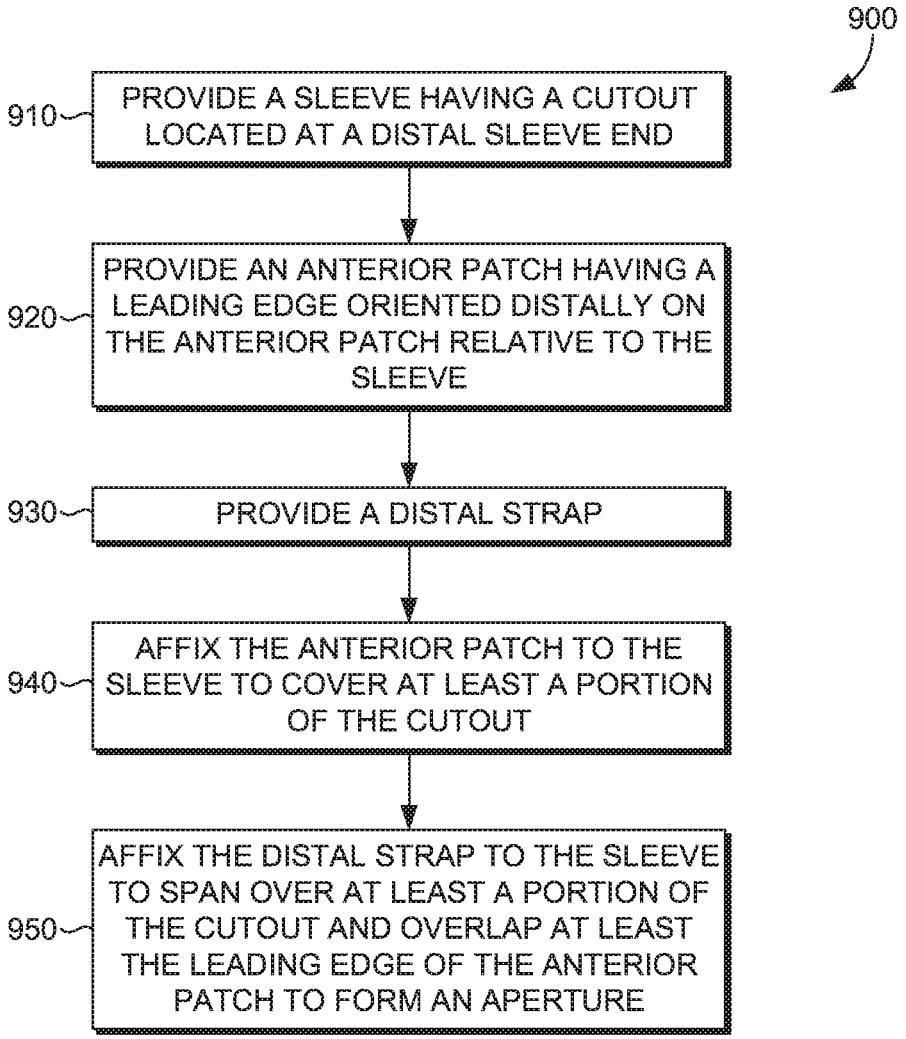
FIG. 13 depicts a flow diagram illustrating a method of manufacturing a sleeve having a sleeve cuff with an aperture for receiving a thumb, in accordance with an aspect described herein.

FIG. 13 depicts a method 900 of manufacturing a sleeve having a sleeve cuff for receiving a thumb through an aperture. Initially, the method 900 of manufacturing a sleeve 210 having a sleeve cuff 100 involves providing a sleeve 210, the sleeve 210 having a cutout 240 located at a distal sleeve end 230, as depicted at block 910. In one aspect, the distal sleeve end 230 is distally located from the wearer's torso when the sleeve is in an as-worn position, the distal sleeve end 230 presents a hand opening allowing a hand of the wearer to communicate through the interior of the sleeve, and the sleeve 210 further including a cutout 240 formed through a sleeve wall 232 of the sleeve, and the cutout 240 having at least one cutout edge 250.

The method 900 further comprises the step of providing an anterior patch 300 having a leading edge 310 oriented distally on the anterior patch 300 relative to the sleeve 210, as depicted in block 920. In one aspect, the anterior patch 300 includes a plurality of trailing edges 320. The plurality of trailing edges 320 on the anterior patch 300 are located proximally from the leading edge 310.

The method 900 further comprises the step of providing a distal strap 400, as depicted in block 930. In an exemplary aspect, the distal strap 400 includes a trailing edge 410 and a plurality of leading edges 420. The distal strap 400 is oriented relative to the sleeve 210 to have the trailing edge 410 located proximally from the plurality of leading edges 420.

The method 900 further comprises the step of affixing the anterior patch 300 to the sleeve 210 to cover at least a portion of the cutout 240, as depicted in block 940. In an aspect, the anterior patch 300 is affixed to the sleeve 210 at the plurality of trailing edges 320.

The method 900 further comprises the step of affixing the distal strap 400 to the sleeve 210 to span over at least a portion of the cutout 240 and overlap at least the leading edge 310 of the anterior patch 300 to form an aperture 110, as depicted in block 950. In an aspect, the distal strap 400 is affixed to the sleeve 210 at the plurality of leading edges 420. In an aspect, the plurality of leading edges 420 are affixed proximate to the distal sleeve end 230 and extend proximally up the sleeve 210 to the distal strap trailing edge 410.

From the foregoing, it will be seen that aspects described herein are well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible aspects described herein may be made without departing from the scope thereof, it is to be understood that all matter herein set forth or shown in the accompanying drawings is to be interpreted as illustrative and not in a limiting sense.

What is claimed is:

1. An article of apparel comprising:

a torso portion;

a left sleeve extending distally away from the torso portion;

a right sleeve extending distally away from the torso portion;

each of the left sleeve and the right sleeve comprising a plurality of sleeve portions, the plurality of sleeve portions comprising:

a proximal end joined to the torso portion;

a distal end located longitudinally opposite the proximal end;

a sleeve wall extending from the distal end to the proximal end;

an opening in the sleeve wall defined by a first edge extending proximally from the distal end, a second edge extending proximally from the distal end, the first edge positioned across the opening from the second edge;

a first panel having a trailing edge, the trailing edge having a first end opposite a second end, the first end directly joined to the first edge and the second end directly joined to the second edge;

a second panel having a leading edge, the leading edge having a third end opposite a fourth end, the third end directly joined to the first edge and the fourth end directly joined to the second edge, wherein the first panel overlaps the second panel such that the trailing edge is farther from the distal end than the leading edge; and an aperture between the first panel and the second panel, the aperture defined by the trailing edge, the leading edge, the first edge, and the second edge, wherein the aperture is manipulable to form a plurality of configurations, the plurality of configurations including at least a closed configuration and an open configuration.

2. The article of apparel of claim 1, wherein the article of apparel comprises an upper body article of apparel.

3. The article of apparel of claim 1, wherein the article of apparel comprises a shirt.

4. The article of apparel of claim 1, wherein the article of apparel comprises a jacket.

5. The article of apparel of claim 1, wherein, in each of the left and right sleeves, the first panel has a first area, the second panel has a second area, and the opening in the sleeve wall has a third area, wherein the sum of the first area plus the second area is greater than the third area by an area of overlap between the first panel and the second panel when in the closed configuration.

6. The article of apparel of claim 1, wherein, in each of the left and right sleeves, the first panel further comprises a first panel leading edge extending from the first edge to the second edge at the distal end.

7. The article of apparel of claim 1, wherein, in each of the left and right sleeves, the closed configuration comprises the trailing edge being proximal to the leading edge at every point between the first edge and the second edge.

8. The article of apparel of claim 1, wherein, in each of the left and right sleeves, the open configuration comprises the trailing edge being distal to the leading edge at an intermediate point between the first edge and the second edge.

9. The article of apparel of claim 1, wherein, in each of the left and right sleeves, the first edge extends proximally from the distal end to a first terminal point and the second edge extends proximally from the distal end to a second terminal point.

10. The article of apparel of claim 9, wherein, in each of the left and right sleeves, the article of apparel further comprising a third edge extending from the first terminal point to the second terminal point.

11. The article of apparel of claim 10, wherein, in each of the left and right sleeves, the second panel is joined to:

the first edge from a first end of the leading edge to the first terminal point;

the second edge from a second end of the leading edge to the second terminal point; and the third edge from the first terminal point to the second terminal point.

12. The article of apparel of claim 11, wherein, in each of the left and right sleeves, the article of apparel further comprising:

a first seam, a second seam, and a third seam, wherein the second panel is joined to the sleeve wall at the first edge with the first seam, wherein the second panel is joined to the sleeve wall at the second edge with the second seam, and wherein the second panel is joined to the sleeve wall at the third edge with the third seam.

13. The article of apparel of claim 12, wherein, in each of the left and right sleeves, the first panel is joined to the sleeve wall at the first edge with the first seam, wherein the first panel is joined to the sleeve wall at the second edge with the second seam.

14. The article of apparel of claim 1, wherein, in each of the left and right sleeves, the trailing edge of the first panel and the leading edge of the second panel each extend from the first edge to the second edge, wherein the first panel trailing edge and the second panel leading edge are parallel to one another.

15. The article of apparel of claim 14, wherein, in each of the left and right sleeves, the first panel further comprises a distal edge that extends from the first edge to the second edge, wherein the first panel distal edge and the first panel trailing edge are parallel to one another.

16. The article of apparel of claim 15, wherein, in each of the left and right sleeves, the distal edge is collinear with the distal end.

17. The article of apparel of claim 15, wherein, in each of the left and right sleeves, a first distance between the trailing edge and the distal edge at the first edge is equal to a second distance between the trailing edge and the distal edge at the second edge.

18. The article of apparel of claim 1, wherein, in each of the left and right sleeves, at least one of the first panel and the second panel comprises a woven material or a knit material.

19. A sleeve comprising:

a proximal end;

a distal end located longitudinally opposite the proximal end;

a sleeve wall extending from the distal end to the proximal end;

an opening in the sleeve wall defined by a first edge extending proximally from the distal end, a second edge extending proximally from the distal end, the first edge positioned across the opening from the second edge;

a first panel having a trailing edge, the first panel positioned between the first edge and the second edge;

a second panel having a leading edge, the second panel positioned between the first edge and the second edge;

a first seam joining the first panel to the first edge and a second seam joining the first panel to the second edge;

the first seam joining the second panel to the first edge and the second seam joining the second panel to the second edge, wherein the first panel overlaps the second panel such that the trailing edge is farther from the distal end than the leading edge; and an aperture between the first panel and the second panel, wherein the aperture is manipulable to form a plurality of configurations, the plurality of configurations including at least a closed configuration and an open configuration.

20. An article of apparel comprising a torso portion and a pair of sleeves, wherein each sleeve of the pair of sleeves comprises an instance of the sleeve of claim 19.

* * * * *